US010278484B2

(12) United States Patent
Hohlbein

(10) Patent No.: US 10,278,484 B2
(45) Date of Patent: May 7, 2019

(54) ORAL CARE IMPLEMENT

(71) Applicant: Colgate-Palmolive Company, New York, NY (US)

(72) Inventor: Douglas Hohlbein, Hopewell, NJ (US)

(73) Assignee: Colgate-Palmolive Company, New York, NY (US)

( * ) Notice: Subject to any disclaimer, the term of this patent is extended or adjusted under 35 U.S.C. 154(b) by 110 days.

(21) Appl. No.: 15/387,011

(22) Filed: Dec. 21, 2016

(65) Prior Publication Data

US 2017/0099939 A1 Apr. 13, 2017

Related U.S. Application Data

(63) Continuation of application No. 14/400,956, filed as application No. PCT/US2012/038235 on May 17, 2012, now Pat. No. 9,554,640.

(51) Int. Cl.

| | |
|---|---|
| ***A46B 5/02*** | (2006.01) |
| ***A46B 9/04*** | (2006.01) |
| ***A46D 3/00*** | (2006.01) |

(52) U.S. Cl.

CPC ..... *A46B 5/02* (2013.01); *A46B 9/04* (2013.01); *A46D 3/00* (2013.01); *A46D 3/005* (2013.01); *A46B 5/028* (2013.01); *A46B 2200/1066* (2013.01)

(58) Field of Classification Search

CPC ..... A46B 9/04; A46B 15/0087; A46B 5/02; A46B 2200/1066; A46D 3/00; A46D 3/005

See application file for complete search history.

(56) References Cited

U.S. PATENT DOCUMENTS

| | | | |
|---|---|---|---|
| 5,440,808 | A | 8/1995 | Wexler |
| 5,517,712 | A | 5/1996 | Schiano |
| 5,881,425 | A | 3/1999 | Hudson et al. |
| 6,138,313 | A | 10/2000 | Barton |
| 6,298,516 | B1 | 10/2001 | Beals |
| 6,345,406 | B1 | 2/2002 | Dodd |
| 6,464,920 | B1 | 10/2002 | Kraemer |
| 6,919,038 | B2 | 7/2005 | Meyer et al. |
| 7,226,555 | B2 | 6/2007 | Weihrauch |

(Continued)

FOREIGN PATENT DOCUMENTS

| | | |
|---|---|---|
| DE | 4408426 | 9/1995 |
| EP | 0673743 | 9/1995 |

(Continued)

OTHER PUBLICATIONS

Computer generated English translation of JP 2002-153322 A, Moriwaka et al., Nov. 2000.*

(Continued)

*Primary Examiner* — Laura C Guidotti

(57) ABSTRACT

An oral care implement is provided. The oral care implement may include a handle comprising a core and a cover enveloping the core. The cover may be formed from a substantially translucent first rigid material. The core may be formed from a second rigid material and a plurality of elements, the plurality of elements suspended within the second rigid material and visible through the cover. In other embodiments the core may include a foamed material.

6 Claims, 3 Drawing Sheets

(56) References Cited

U.S. PATENT DOCUMENTS

| | | | | |
|---|---|---|---|---|
| 2002/0124864 | A1* | 9/2002 | Gross | A46B 5/02 132/311 |
| 2003/0070259 | A1* | 4/2003 | Brown | A46B 5/02 16/436 |
| 2003/0116884 | A1 | 6/2003 | Wagstaff | |
| 2003/0135943 | A1 | 7/2003 | Meyer et al. | |
| 2005/0015907 | A1 | 1/2005 | Georgi | |
| 2005/0193510 | A1 | 9/2005 | Kemp | |
| 2009/0313778 | A1 | 12/2009 | Wong | |
| 2010/0000039 | A1 | 1/2010 | Vega-Cortes | |
| 2010/0125962 | A1 | 5/2010 | Davies et al. | |
| 2011/0047735 | A1 | 3/2011 | Jaksha | |
| 2012/0255136 | A1* | 10/2012 | Jimenez | A46B 5/02 15/167.1 |
| 2012/0272468 | A1 | 11/2012 | Weisman | |
| 2013/0198986 | A1 | 8/2013 | Mantell et al. | |
| 2014/0173853 | A1 | 6/2014 | Kirchhofer et al. | |

FOREIGN PATENT DOCUMENTS

| | | |
|---|---|---|
| EP | 1951084 | 8/2008 |
| FR | 2921547 | 9/2007 |
| GB | 2370220 | 6/2002 |
| JP | 2002-153322 | 5/2002 |
| RU | 94041837 | 8/1996 |
| WO | 2002/006034 | 1/2002 |
| WO | 2013/017283 | 2/2013 |

OTHER PUBLICATIONS

International Search Report and the Written Opinion issued in International Application PCT/US2012/038235 dated Feb. 7, 2013.

Computer generated English Translation of FR 2921547A1, Sep. 2007, Le et al. FR.

* cited by examiner

ORAL CARE IMPLEMENT

CROSS-REFERENCE TO RELATED APPLICATIONS

The present application is a continuation of U.S. patent application Ser. No. 14/400,956, filed Nov. 13, 2014, which is a U.S. national stage entry under 35 U.S.C. § 371 of Patent Cooperation Treaty Patent Application No. PCT/US2012/038235, filed May 17, 2012, the entireties of which are incorporated herein by reference.

BACKGROUND OF THE INVENTION

Oral care implements, e.g. toothbrushes and soft tissue cleaners such as tongue scrapers, commonly have handles that are made by injection molding a polymer resin in a cavity of a mold and then allowing the polymer to harden. The polymer resin used typically is a virgin material, i.e. a material that has not been previously used for the manufacture of an article. While this process has been found to provide a handle with an acceptable, smooth, comfortable surface for a user to hold during use of the implement, using virgin material consumes the earth's natural resources of the raw materials that at least partially make up the virgin material. Moreover, processing raw material to create virgin material expends a great deal of energy.

It has been proposed to use recycled plastic materials in the manufacture of toothbrushes. For example, US2010/0000039 describes a portable toothbrush made of recycled plastic, WO2011/025810 describes a toothbrush with a solid handle made of an admixture of cornstarch and recycled polypropylene, and U.S. Pat. No. 5,881,425 describes a toothbrush of which a handle is made of a material composition comprising at least about 90% recycled plastic. However, recycled plastic materials sometimes include foreign materials, such as foil, labels, and glue. Accordingly, the recycled plastic material needs cleaning and sieving to remove such foreign materials such that the cleaned material is usable to make implements with acceptable surfaces, or else handles made from such recycled materials will have an unattractive appearance and/or an uneven surface texture that is not comfortable to hold. Moreover, some consumers also develop the perception that post-consumer recycled materials carry germs.

Accordingly, there is a need for an improved oral care implement, with a handle that is made from a material the use of which has a reduced impact on the environment, that has an acceptable surface for a user to hold during use of the implement, and that allays perceived consumers' safety concerns.

SUMMARY OF THE INVENTION

A first aspect of the present invention provides an oral care implement comprising: a handle comprising a core and a cover enveloping the core; the cover comprising a substantially translucent first rigid material; and the core comprising a second rigid material and a plurality of elements, the plurality of elements suspended within the second rigid material and visible through the cover.

A second aspect of the present invention provides an oral care implement comprising: a handle comprising a core and a cover enveloping the core; the cover comprising a substantially translucent first rigid material; and the core comprising a foamed material.

A third aspect of the present invention provides an oral care implement comprising: a handle having a core and a cover surrounding an entirety of the core so that no portion of the core is exposed; and a head comprising at least one cleaning element, the head being connected to the handle; and wherein the head and the cover of the handle are integrally formed as a unitary part.

Herein "enveloping" means "completely covering or surrounding." In certain embodiments, portions of the oral care implement are formed of recycled material. Herein "recycled material" preferably means a material that has been previously used in the manufacture of an object or article. Herein "post-consumer recycled material" means material that has formed at least part of an object or article that has been used by a consumer or end-user. Herein "pre-consumer recycled material" means material that has formed at least part of an object or article that has not been used by a consumer or end-user. Preferably, "pre-consumer recycled material" is that which has never left the site of manufacture of the object or article formed using the material. Herein "virgin material" means material that is free or substantially free of recycled material.

In some embodiments the core comprises recycled material and it is completely covered or surrounded by the cover. Thus, the recycled material is not exposed at an outer surface of the handle. That is, the core is isolated from an outer surface of the implement. Accordingly, the oral care implement is made at least partially of recycled material, yet the handle may be provided with a smooth, comfortable and visually-acceptable surface for a user to hold during use of the implement, regardless as to the composition, form or surface finish of the core.

Preferably the recycled material comprises recycled plastic material, and more preferably the recycled material comprises post-consumer recycled plastic material. The recycled material may comprise a polymer, such as a thermoplastic polymer. The recycled material may comprise any one of, or any two or more of, polypropylene (PP), polystyrene (PS), low density or high density polyethylene (LDPE, HDPE), polyethylene terephthalate (PET), acrylonitrile butadiene styrene (ABS), cellulose propionate (CP), polyacrylate, polycarbonate, and styrene acrylonitrile (SAN). The core may comprise a foamed material. That is, the core may comprise an expanded foam structure.

Optionally, the recycled material comprises one or more of a plastic, a metal, an alloy, a ceramic, glass, a composite, or organic material, such as wood dust, wood saw dust or wood chippings.

Optionally, the core comprises the recycled material and a further (optionally non-recycled) material, such as a plastic, a metal, an alloy, a ceramic, glass, a composite, or organic material, such as wood dust, wood saw dust or wood chippings. Alternatively or additionally, the recycled material may comprise two or more different materials. The core may have at least one part that is hollow. Alternatively or additionally, the core may have one or more holes therethrough.

Preferably the core comprises at least 50% by weight recycled material. More preferably, the core comprises at least 75% by weight recycled material. Still more preferably, the core comprises at least 90% by weight recycled material. Yet more preferably, the core comprises at least 95% by weight recycled material. Most preferably, the core comprises at least 99% by weight recycled material.

Preferably, the cover is free of post-consumer recycled material. More preferably, the cover is free of recycled material. Optionally, the cover comprises pre-consumer recycled material, such as between 0 and 30% by weight pre-consumer recycled material. Preferably, the cover comprises or consists of virgin food-grade plastic. The cover may comprise a bio-sourced polymer. Optionally, the cover comprises a cellulose polymer, such as cellulose acetate propionate (CAP) or cellulose acetate butyrate (CAB).

The cover may be at least partially transparent and/or at least partially opaque and/or at least partially translucent.

Optionally, a first portion of the cover is made from a first material and a second portion of the cover is made from a second material. The second material may be the same material as the first material or a different material to the first material. In either case, the first and second materials may have different colours. The first material may be harder than the second material. For example, the first material may be a hard material and the second material may be an elastic material. The first material may comprise a polymer, such as a thermoplastic polymer. The second material may comprise an elastomer or rubber, such as a thermoplastic elastomer. Optionally, cover comprises a plurality of second portions spaced apart from one another on the surface of the implement.

Optionally, the cover has been overmolded onto the core.

Optionally, the handle comprises one or more sections that are overmolded onto the cover and out of contact with the core.

The head may comprise at least one tooth cleaning element, in which case the oral care implement comprises a toothbrush. Alternatively or additionally, the head may comprise at least one soft tissue cleaning element, such that the oral care implement comprises a soft tissue cleaner.

A second aspect of the present invention provides a method of manufacturing an oral care implement, the method comprising: providing recycled material; and enveloping the recycled material with cover material to form a handle of the oral care implement, the handle having a core comprising the recycled material and a cover comprising the cover material enveloping the core.

Optionally, the enveloping comprises enveloping the recycled material with the cover material to form a body comprising the handle and a head of the oral care implement. Preferably, the method comprises providing the head with at least one cleaning element.

The method may comprise forming the recycled material into a shape to create the core. Optionally, the forming comprises injecting the recycled material into a cavity of a mold in a flowable state and allowing the recycled material to harden. The forming may comprise extruding the recycled material. Alternatively, the core may be provided as a pre-formed shape of core material comprising or consisting of recycled material.

The method may comprise foaming the recycled material.

The method may comprise one or both of forming at least one part of the core that is hollow and forming one or more holes through the core.

The enveloping may comprise enveloping the core with the cover material, preferably when the core is hard. For example, the enveloping may comprise overmolding the core with the cover material.

Optionally the enveloping comprises: covering one or more portions of the core with the cover material while the cover material is flowable and while the core is spaced from walls of a cavity of a mold using one or more spacers in contact with a surface of the core; and withdrawing the one or more spacers from the surface of the core while the cover material is flowable.

Optionally the cover material comprises a first material and a second material; and the enveloping comprises covering one or more first parts of the core with the first material and covering one or more second parts of the core with the second material. For example, the enveloping may comprise covering the one or more first parts of the core with the first material while the one or more second parts of the core are concealed, exposing the one or more second parts of the core, and then covering the one or more second parts of the core with the second material. In any event, the second material may be the same material as the first material or a different material to the first material. The first and second materials may have different colours. Optionally, the first material comprises a polymer, such as a thermoplastic. Optionally, the second material comprises an elastomer, such as a thermoplastic elastomer.

Optionally the enveloping comprises enveloping core material, comprising the recycled material, with cover material while the core material is soft and/or in a flowable state. For example, the enveloping may comprise providing a mass of the cover material in a flowable state, such as in a cavity of a mold, and then injecting the core material into the mass. The core and cover materials may then be allowed to harden.

Optionally the recycled material comprises recycled plastic material, such as post-consumer recycled plastic material. The recycled material may comprise two or more different materials.

Optionally the providing the recycled material comprises melting pellets or flakes of recycled plastic material. Further optionally, the providing the recycled material comprises granulating one or more plastic structures, such as bottles, cartons, packaging or disposable goods, to create the pellets or flakes of recycled plastic material.

Optionally the method comprises providing the recycled material and a further material that is a different material to the recycled material, such as non-recycled material, and enveloping the recycled material and the further material with the cover material to form the handle of the oral care implement, the handle having a core comprising the recycled material and the further material and a cover comprising the cover material enveloping the core. The further material may, for example, comprise a plastic, a metal or an alloy, a ceramic, glass, a composite, or organic material such as wood dust, wood saw dust or wood chippings.

Preferably the cover material is free of post-consumer recycled material. More preferably, the cover is free of recycled material. More preferably, the cover comprises or consists of virgin food-grade plastic. Optionally, the cover comprises pre-consumer recycled material, such as between 0 and 30% by weight pre-consumer recycled material. The cover may comprise a bio-sourced polymer. Optionally, the cover comprises a cellulose polymer, such as cellulose acetate propionate. The cover may comprise a colourant.

A third aspect of the present invention provides an oral care implement obtainable by the method of the second aspect of the present invention. The oral care implement may comprise any of the optional features discussed above in relation to the first aspect of the present invention.

DETAILED DESCRIPTION OF THE PREFERRED EMBODIMENTS

Figure 1:
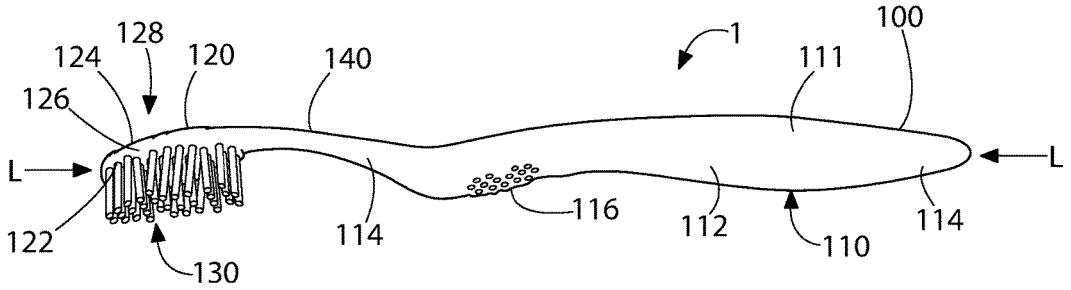
FIG. 1 is a perspective view of an oral care implement according to a first embodiment of the present invention.

The following description of the preferred embodiments is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

In the following description, the invention is discussed in terms of a toothbrush, but could be in the form of another oral care implement or ansate implement, such as a soft tissue cleaner. The oral care implement is preferably self-contained, portable and hand-held. Further, it is understood that other embodiments may be utilized and structural and functional modifications may be made without departing from the scope of the present invention.

Figure 2:
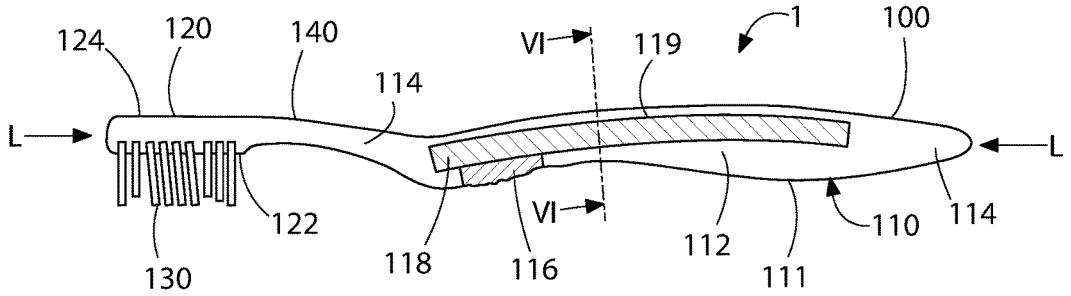
FIG. 2 is a longitudinal cross sectional view of the oral care implement of FIG. 1.

FIGS. 1 and 2 illustrate an oral care implement, in this case a toothbrush, according to a first embodiment of the present invention, generally designated with the reference numeral 1. The toothbrush 1 generally comprises a body 100 that comprises a handle 110, a neck 140 and a head 120. Accordingly, the implement is an ansate implement 1. The neck 140 is disposed at one longitudinal end of the handle 110, and it is by the neck 140 that the handle 110 is connected to the head 120. The head 120 is that part of the toothbrush 1 that is intended to be inserted into a user's mouth during use, although in practice at least part of the neck 140 may also be inserted into the user's mouth during use. The toothbrush 1 has a longitudinal axis L, which may also be considered a longitudinal axis L of the head 120 and the neck 140.

The head 120 carries one or more cleaning elements 130. The cleaning elements 130 extend beyond a front face 122 of the head 120. In this embodiment, the cleaning elements 130 comprise tooth cleaning elements but, in a variation to this embodiment, they may instead or additionally comprise soft tissue cleaning elements. The tooth cleaning elements 130 may be connected to the head 120 by any suitable conventional attachment method used in the art including, without limitation, anchor free tufting (AFT), in mold tufting (IFT), stapling and anchoring. The tooth cleaning elements 130 may include a variety of bristle and/or flexible elastomeric cleaning and/or polishing elements. It should be noted that the cleaning elements 130 in the drawings are illustrated substantially in block without the individual bristle strands being detailed, for convenience and clarity.

Any provided bristles are preferably made from nylon, although other materials could be used. The bristles also preferably have a generally circular cross-sectional shape, but could have other cross-sectional shapes. The diameter of the bristles can vary depending on the desired cleaning action of the bristles. Any provided soft tissue cleaning element(s) are preferably made from an elastomer, such as a thermoplastic elastomer (TPE), or rubber. The soft tissue cleaning element(s) may comprise one or more tissue engaging elements, such as elongated cleaning elements, which may be linear or nonlinear, and/or one or more nubs.

As used herein, a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

The cleaning elements 130 carried by the head 120 may be arranged in any suitable pattern and the invention is not limited by any particular arrangement, shape, type, and/or number of cleaning element(s) 130 provided.

In some embodiments, any one or more of the front face 122 itself, a back face 124 opposite to the front face 122, and the two opposing lateral sides 126, 128 of the head 120 may include an elastomeric tongue cleaner and/or other tooth or soft tissue cleaning elements (not shown), of any of the forms discussed above. The head 120 in this embodiment has an elongated elliptical or oval shape in top view; however, in other embodiments the head 120 may be round or substantially rectangular in top view.

The handle 110 is a member that is dimensioned so that a user can readily grip and manipulate the implement 1. The handle 110 may have any suitable ergonomic and aesthetically pleasing configuration dimensioned to be gripped by a user, and is not limited to the appearance illustrated in the enclosed drawings.

The handle 110 comprises an outer cover, shell or housing 112 and a core 118 that is enveloped by the cover 112. That is, the cover 112 completely covers or surrounds the core 118, such that no part of the core 118 is exposed to the exterior of the implement 1. The cover 112 is in contact with a surface 119 of the core 118. The cover 112 is free of post-consumer recycled material and, preferably, is made of virgin food-grade plastic. In a variation to this embodiment, the cover 112 may comprise pre-consumer recycled material, optionally in an amount up to 30% wt of the cover 112. More specifically, a first portion 114 of the cover 112 is made from a hard bio-sourced cellulose polymer such as cellulose acetate propionate (CAP) or cellulose acetate butyrate (CAB). The first portion 114 of the cover 112 is transparent, such that the core 118 is visible through the first portion 114 of the cover 112 from the exterior of the implement 1. In variations to this embodiment, the first portion 114 of the cover 112 may instead be wholly, or in part, translucent or opaque. In a further variation to this embodiment, the first portion 114 is made from polypropylene (PP) or a still different material.

A second portion 116 of the cover 112 is made from an opaque and elastic material, in this case a thermoplastic elastomer (TPE). The second portion 116 is located at that part of the handle 110 where a user's thumb would rest during normal use of the implement 1, and acts as a resilient grip.

The first portion 114 of the cover 112 is in contact with a first part of the core 118 and the second portion 116 of the cover 112 is in contact with a second part of the core 118. That is, each of the first and second portions 114, 116 is in contact with the surface 119 of the core 118. Accordingly, each of the first and second portions 114, 116 is considered to be comprised in the cover 112.

Figure 3:
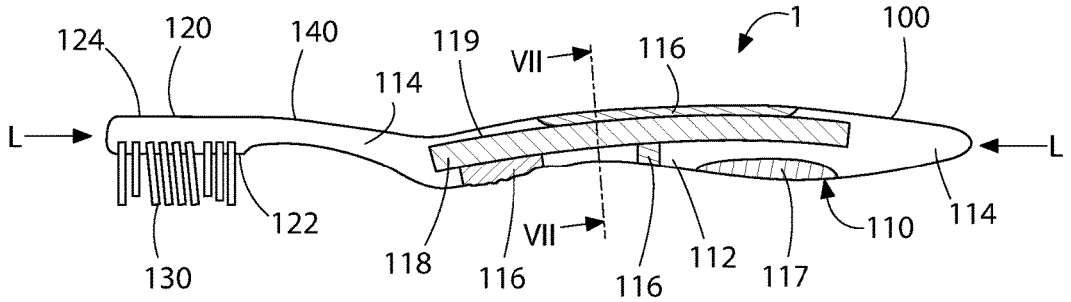
FIG. 3 is a longitudinal cross sectional view of an oral care implement according to a second embodiment of the present invention.

In a variation to the illustrated first embodiment, the handle 110 has a plurality of second portions 116, rather than only one second portion 116. Such an implement 1 according to a second embodiment of the present invention is shown in FIG. 3. In FIG. 3, like elements are indicated with the same reference numerals as used in FIG. 2. In the interest of conciseness, the elements common to the two embodiments will not be described in detail again with reference to FIG. 3. It should be recognized that all of the possible variations to the first embodiment described herein are equally applicable to the second embodiment.

The plurality of second portions 116 are spaced apart from one another on a surface of the implement 1 at locations along the longitudinal axis of the handle 110 and/or around the handle 110. The plurality of second portions 116 are all made of TPE. There is thus provided a plurality of resilient grips for contacting a user's hand during normal use of the implement 1. In a variation to this embodiment, the second portions 116 may be made of different materials. One, or more than one, of the plurality of spaced apart second portions 116 may be made from an elastic material, such as TPE. Alternatively or additionally, one or more than one, or all, of the plurality of spaced apart second portions 116 may be made of a rigid material, such as PP, CAP or CAB. When visually distinct from the first portion 114 of the handle 110, e.g. when the first portion 114 has a different colour to one or all of the second portions 116, regardless as to whether the portion(s) 114, 116 are of the same material, the plurality of spaced apart second portions 116 may provide the handle 110 with an appealing appearance.

Each of the second portions 116 of the cover 112 is in contact with a respective second part of the core 118. Indeed, each of the first and second portions 114, 116 is in contact with the surface 119 of the core 118. Accordingly, each of the first and second portions 114, 116 is considered to be comprised in the cover 112.

In the implement 1 of the second embodiment shown in FIG. 3, the handle 110 has a further section 117, which is made from TPE, and which forms a further part of a grip of the handle 110. The section 117 of the handle 110 is not in contact with any part of the core 118, and thus does not form part of the cover 112 as such. Moreover, as a result of the provision of the section 117, not all of the outer surface 111 of the handle 110 is formed by the cover 112. That is, the surface 111 is formed by the cover 112 and also by another section 117 of the handle 110. The section 117 has been overmolded onto the cover 112. In a variation to this embodiment, the section 117 may be adhered onto the cover 112. Of course, in a variation to the illustrated second embodiment, the handle 112 may comprise more than one such section 117. Moreover, one or more such sections 117 may be provided in the implement 1 of the first embodiment. In any event, when more than one section 117 is provided, the plurality of sections 117 may all be made of the same material or different materials.

Figure 4:
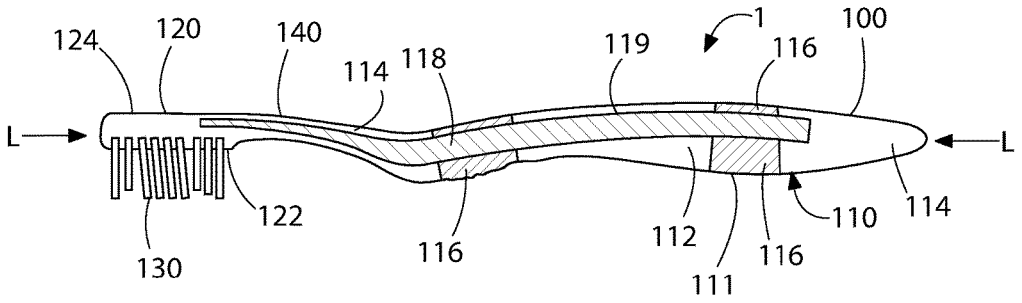
FIG. 4 is a longitudinal cross sectional view of an oral care implement according to a third embodiment of the present invention.

A third embodiment of an implement 1 according to the present invention is shown in FIG. 4. In FIG. 4, like elements are indicated with the same reference numerals as used in FIGS. 2 and 3. In the interests of conciseness, the elements common to the three embodiments will not be described in detail again with reference to FIG. 4. It should be recognised that all of the possible variations to the first and second embodiments described herein are equally applicable to the third embodiment.

In the third embodiment, the core 118 extends from the handle 110 into the neck 140. Indeed, the core 118 extends from the handle 110 into both the neck 140 and the head 120. Accordingly, a greater proportion of the oral care implement 1 may be made of recycled material, such as post-consumer recycled material, yet the implement 1 may be provided with a smooth, comfortable surface, a part of which will be held by a user and a part of which will contact tissue inside the user's mouth, during use of the implement 1. The whole of the core 118 is still enveloped by the cover 112 in a similar manner to that of the first and second embodiments. Accordingly, in the third embodiment, the recycled material core 118 still is not exposed at an outer surface of the implement 1.

Figure 5:
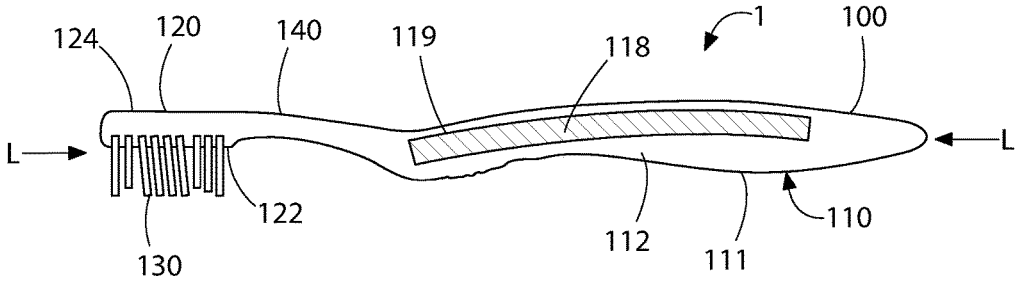
FIG. 5 is a longitudinal cross sectional view of an oral care implement according to a fourth embodiment of the present invention.

In variations to the illustrated first, second and third embodiments, the cover 112 of the handle 110 may have a plurality of first portions 114, rather than only one first portion 114 as shown in FIGS. 1 to 4. The plurality of first portions 114 may be spaced apart from one another at locations along the longitudinal axis of the handle 110 and/or around the handle 110, and separated by one or more second portions 116. The plurality of first portions 114 may all be made of the same material or different materials. A fourth embodiment of an implement 1 according to the present invention is shown in FIG. 5. In FIG. 5, like elements are indicated with the same reference numerals as used in FIGS. 2 to 4. In the interests of conciseness, the elements common to the four embodiments will not be described in detail again with reference to FIG. 5. It should be recognized that all of the possible variations to the first, second and third embodiments described herein are equally applicable to the fourth embodiment.

The handle 110 of the fourth embodiment of an oral care implement 1 comprises a core 118 and a cover 112 enveloping the core 118, but excludes any part equivalent to the section 117 shown in FIG. 3, and excludes any portion equivalent to the second portion(s) 116 shown in FIGS. 1 to 4. Accordingly, the cover 112 is a unitary molded piece molded over the core 118, preferably according to a method discussed below. The cover 112 is opaque or translucent, such that the core 118 is not visible or only just visible from the exterior of the implement 1.

In each of the first, second and fourth embodiments, the neck 140 and the head 120 of the implement 1 are formed by the cover 112. That is, the head 120, the neck 140, and the cover 112 of the handle 110 are all integrally formed as one unitary molded part. In the third embodiment, the neck 140 and the head 120 of the implement 1 are partially formed by the cover 112. That is, the cover 112 of the handle 110, and the outer parts of the head 120 and neck 140 are all integrally formed as one unitary molded part. In each of the embodiments, none of the core 118 is exposed at an outer surface of the implement 1.

In each of the first to fourth embodiments, the cover 112 is overmolded onto the surface 119 of the core 118. Preferably this is achieved using one of the methods of manufacture discussed below. However, in respective variations to these four embodiments, the cover 112, or only some of the portions 114, 116 thereof, may instead be disposed on the surface 119 of the core 118 by some other method. For example, the cover 112, or only some of the portions 114, 116 thereof, may instead be adhered to the surface 119 of the core 118, or coated onto the surface 119 of the core 118 as a coating or a film.

Figure 6:
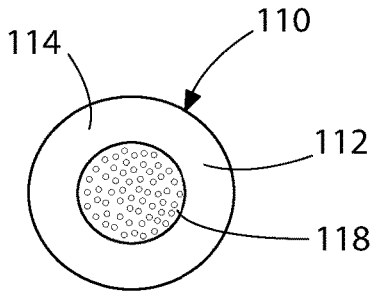
FIG. 6 is a transverse cross sectional view of the oral care implement according to the first embodiment taken on line VI-VI of FIG. 2.
Figure 7:
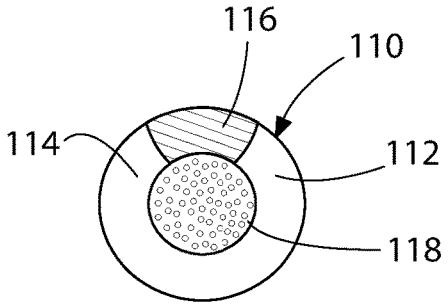
FIG. 7 is a transverse cross sectional view of an oral care implement according to another embodiment of the present invention.
Figure 8:
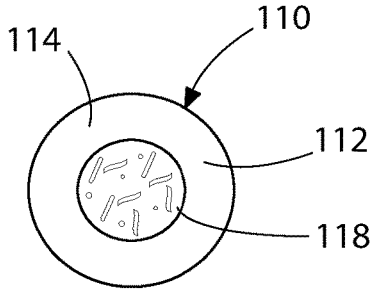
FIG. 8 is a transverse cross sectional view of the oral care implement according to the second embodiment taken on line VII-VII of FIG. 3.
Figure 9:
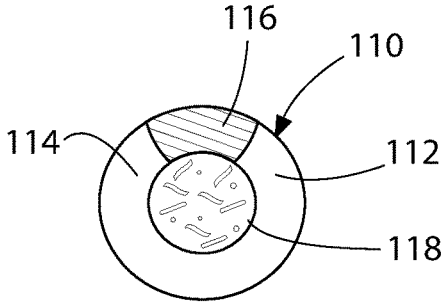
FIG. 9 is a transverse cross sectional view of an oral care implement according to another embodiment of the present invention.

In each of the first to fourth embodiments, the core 118 comprises foamed, post-consumer recycled polypropylene (PP), as illustrated by way of example in FIGS. 6 and 7. FIG. 6 is a cross sectional view through the toothbrush of the first embodiment and clearly showing the foamed core 118 in contrast to the substantially homogeneous first portion 114 of the cover 112. FIG. 7 is a cross sectional view through the toothbrush of the second embodiment, similarly showing the foamed core 118, in contrast to the respective substantially homogenous first and second portions 114, 116 of the cover 112. In variations to these embodiments, the core 118 comprises two or more recycled different materials, such as two or more different plastic materials. For example, the core 118 may comprise two or more post-consumer recycled plastic materials, such as materials selected from the group comprising polypropylene (PP), polystyrene (PS), low density or high density polyethylene (LDPE, HDPE), polyethylene terephthalate (PET), acrylonitrile butadiene styrene (ABS), cellulose propionate (CP), polyacrylate, polycarbonate, and styrene acrylonitrile (SAN). In further variations, in addition to one or more recycled plastic materials, in other embodiments, the core 118 may also comprise one or more further non-recycled (i.e. virgin) plastic materials, such as one or more materials selected from the above list. Alternatively or additionally, in addition to one or more recycled plastic materials, the core 118 may also comprise one or more further recycled or non-recycled (i.e. virgin) non-plastic materials, such as a metal or an alloy, a ceramic, glass, a composite, or organic material such as wood dust, wood saw dust or wood chippings. By way of example, FIGS. 8 and 9 show respective variations to the arrangements shown in FIGS. 6 and 7, in which variations the core 118 comprises pieces or chunks of a solid material, in this case wood saw dust, suspended in polymer matrix, in this case a polypropylene binder.

In the first to third embodiments, the respective first portions 114 of the cover 112 are of a transparent material, and the respective cores 118 include a colorant that has been added to the recycled material so as to enhance the visibility of the core 118 through the cover 112. However, in variations to these embodiments, the core 118 may exclude a colorant (or at least a colorant that has been added to the recycled material during the manufacture of the implement 1 from the recycled material), particularly in cases when the whole of the cover 112 is opaque.

In each of the first to fourth embodiments, the core 118 may consist of about 95% by weight recycled material. However, in respective variations to these embodiments, the core 118 may consist of more or less than this percentage by weight recycled material. For example, in some embodiments, the core comprises only at least 50% by weight recycled material. In other embodiments, the core 118 comprises at least 75% by weight recycled material. In preferred embodiments, the core 118 comprises at least 90% by weight recycled material, more preferably at least 95% by weight recycled material, and most preferably at least 99% by weight recycled material. The core 118 may be free of foaming agent and/or colourant. Naturally, the more recycled material provided in the core 118, the less virgin material is used in the manufacture of the implement 1.

In each of the first, second and fourth embodiments, the core 118 makes up approximately 20 to 25% of the volume of the implement 1 and approximately 30 to 40% of the volume of the handle 110. In the third embodiment, the core 118 makes up approximately 30 to 40% of the volume of the implement 1 and approximately 30 to 40% of the volume of the handle 110. In variations to these embodiments, the cover 112 may be thinner than that shown in FIGS. 2 to 5, in which case the core 118 may make up a greater proportion of the implement 1 and its handle 110. For example, in some embodiments, the core 118 may form more than 70% of the volume of the handle 110. In preferred embodiments, the core 118 forms more than 80% of the volume of the handle 110, and in the most preferred embodiment the core 118 forms more than 90% of the volume of the handle 110. In some embodiments, as discussed above, the cover 112 part of the handle 110 may be a coating or film provided on the core 118, in which case the core may form more than 95% of the volume of the handle 110 or even more than 98% of the volume of the handle 110.

In the four embodiments discussed in detail herein, the head 120 is irremovably connected to the handle 110 via the neck 140. In respective variations to the first, second and fourth embodiments, the head 120 may be detachably connectable to the handle 110 to enable substitution of the head 120 when the cleaning elements 130 have become worn, without needing to dispose of the whole implement 1. In such variations, either the neck 140 is removable from the handle 110 with the head 120, or the neck 140 is removable from the head 120 with the handle 110.

In respective variations to the above described first to fourth embodiments, the first and section portions 114, 116 of the cover 112 may be made of the same material, such as PP, optionally with the first portion 114 coloured a different colour to the second portion(s) 116.

In variations to the illustrated second and third embodiments, two or more of the second portions 116 that are spaced from one another on the surface of the implements 1 may be in direct communication with each other underneath the surface of the implements 1. For example, a hole (not shown) may be provided through the core 118 and/or through the first part 114, within which hole material forming two or more of the second portions 116 is located. The hole would preferably be circumferentially complete. Accordingly, during manufacture of the implement 1, it may be possible to form the second sections 116 that contact each other using a single shot of injected material.

A first method for forming an oral care implement in accordance with the present invention will now be described. The implement 1 of the second embodiment shown in FIG. 3 may be obtained by this first method.

As a first step, one or more post-consumer plastic structures, such as bottles, cartons, packaging or other disposable goods (such as pre-used oral care implements), made of a thermoplastic, such as polypropylene are processed by methods known in the art to create a material comprising, and preferably consisting at least substantially entirely of, recycled thermoplastic.

The recycled thermoplastic is then melted and injected into the cavity of a mold, in order to form the core 118 by injection molding. Any method for forming the core 118 by injection molding may be utilised. However, a specific example is given below for completeness.

The recycled material, possibly in the form of pellets, is introduced to a hopper or cylinder of an injection molding machine, in which hopper the material is plasticised and mixed, through a combination of mechanical and thermal treatment. A colourant, possibly in the form of pellets, may be added to the recycled material in the hopper to be plasticized and melted together, in order to provide the resultant core 118 with a coloured appearance. A foaming agent also may be added into the hopper to cause subsequent foaming of the material. Alternatively, the colourant and/or the foaming agent can be added to the recycled material after it is plasticized and melted.

The recycled material is fed as core material in a flowable state from the hopper, through a supply conduit into a first cavity of a mold, which first cavity is formed by walls of respective mold halves of the mold. The first cavity has a shape corresponding to the desired shape of the core.

The mold is cooled to cause the core material to harden. Moreover, as the material includes the foaming agent, the material foams within the first cavity. Pressure in the first cavity may be reduced, so as to encourage foaming of the material. Once the hard core 118 has been formed, the mold halves are separated from each another and the core 118 is ejected or otherwise removed from the first cavity of the mold.

Although in this example the core 118 is formed by injection molding, the core may in other embodiments be created by any other method involving forming core material comprising or consisting of recycled material into a shape, such as cutting the core 118 from a larger piece of material, or extruding the core material (comprising or consisting of recycled material) to form the core 118. In cases when the core 118 is formed by extrusion, the core 118 may be formed with at least one hollow part such that at least a part of the core 118 is formed as a tube, in order to reduce the amount of material required to form the core 118 and the implement 1 overall. In one example extrusion process, the core material (comprising or consisting of recycled material) may be extruded from an annular die and then cut to length while still soft, resulting in a pinched-shut cut at each end of the core 118, which thus seals ends of the core to create an air bubble in the core 118. In another example extrusion process, the core material (comprising or consisting of recycled material) may be extruded from an annular die and then cut to length after the core material 118 has been allowed to completely or partially harden, resulting in a core 118 having a tubular form. In further variations to the method, the core 118 may be provided as a pre-formed shape of core material (comprising or consisting of recycled material).

Once provided, the hard core 118 is then placed in a second cavity (in either the first mold or a second mold) which has a first volume corresponding to the shape of the head 120 and neck 140 of the implement 1 to be formed, and a second volume corresponding to the shape of the first portion 114 of the cover 112 of the handle 110. The first and second volumes are parts of the same, second cavity and thus are in fluid communication with each other. The first volume has a shape suitable to cause tuft holes to be formed in the head 120, in which holes tooth cleaning elements 130 can later be disposed using staples. The second volume has a volume greater than that of the first cavity, to allow first cover material that will form the first portion 114 of the cover 112 to flow around the core 118 and contact a first part of the surface 119 of the core 118. The core 118 is spaced from walls of the second cavity by one or more spacers, such as shut-offs, which contact second parts of the surface 119 of the core 118. Accordingly, the second parts of the surface 119 are concealed from the second cavity whereas the first part of the surface 119 of the core 118 is exposed to the second cavity.

Thereafter, the first cover material, which in this example is free of post-consumer recycled material (optionally is virgin food-grade plastic) and comprises cellulose polymer, is introduced to the second cavity in a flowable state. In a variation to this embodiment, the first cover material may comprise pre-consumer recycled material. Sufficient first cover material is provided to fully form the first portion 114 of the cover 112. The first cover material covers the first part of the surface 119 of the core 118 while the second parts of the surface 119 are concealed. The first cover material is thereafter allowed to harden. Accordingly, the first portion 114 of the cover 112 is overmolded onto the core 118.

Next, mold halves of the second mold are separated from each another and the combination of the head 120, neck 140, first portion 114 and core 118 is ejected or otherwise removed from the second cavity of the second mold.

The combination is then placed in a third cavity (in either the first mold or another mold) which third cavity has a first volume corresponding to the shape of the head 120 and neck 140, and a second volume corresponding to the shape of the full handle 110. The first and second volumes are parts of the same, third cavity and thus are in fluid communication with each other. The first volume has a volume identical in shape and size to that of the second cavity. On the other hand, the second volume has a volume greater than that of the second cavity, to allow second cover material that will form the second portions 116 of the cover 112 and the section 117 to flow around the combination and contact the second parts of the surface 119 of the core 118. Accordingly, the second parts of the surface 119 are exposed to the third cavity.

Thereafter, the second cover material, which in this example comprises a thermoplastic elastomer (TPE), is introduced to the third cavity in a flowable state. Sufficient second cover material is provided to fully form the second portions 116 of the cover 112 and to form the section 117. The second cover material covers the second parts of the surface 119 of the core 118 while the first part of the surface 119 is concealed by the first portion 114. The second cover material is thereafter allowed to set.

Accordingly, the second portions 116 of the cover 112, and indeed the whole cover 112, is overmolded onto the core 118. That is, the core 118 is enveloped by cover material, which cover material comprises the first cover material and the second cover material.

Next, mold halves that form the third cavity are separated from each another and the body 100 of the implement 1 is ejected or otherwise removed from the third cavity.

Finally, the body 100 is subjected to a process for disposing tooth cleaning elements 130 in the tuft holes formed in the head 120, to obtain a finished implement 1. In this embodiment the process involves attaching bundles of bristles 130 in the holes using staples, according to a method that may be known in the art.

A second method for forming an oral care implement in accordance with the present invention will now be described. The implement 1 of the first embodiment shown in FIGS. 1 and 2 may be obtained by this second method.

The second method is substantially the same as the described first method. However, in the second method, once provided, and when in the second cavity, the hard core 118 is spaced from walls of the second cavity by only one spacer, such as a shut-off, which contacts a single second part of the surface 119 of the core 118. Thereafter, the first cover material is introduced to the second cavity in a flowable state and covers the first part of the surface 119 of the core 118 while the second part of the surface 119 is concealed, and is then allowed to harden.

Mold halves forming the second cavity are separated from each another and the combination of the head 120, neck 140, first portion 114 and core 118 is ejected or otherwise removed from the second cavity.

When the combination is subsequently placed in the third cavity, the second volume of the third cavity has a volume greater than that of the second cavity, to allow the second cover material that will form the single second portion 116 of the cover 112 to flow around the combination and contact the single second part of the surface 119 of the core 118. Accordingly, the single second part of the surface 119 is exposed to the third cavity. When the second cover material is introduced to the third cavity in a flowable state, only sufficient second cover material to fully form the single second portion 116 of the cover 112 need be provided. The second cover material covers the single second part of the surface 119 of the core 118 while the first part of the surface 119 is concealed by the first portion 114. The second cover material is thereafter allowed to set. Accordingly, the second portion 116 of the cover 112, and indeed the whole cover 112, is overmolded onto the core 118 so that the cover 112 envelops the core 118.

Finally, the body 100 is subjected to a process for disposing tooth cleaning elements 130 in the tuft holes formed in the head 120, to obtain a finished implement 1.

In variations to the first and second methods of the present invention, the first and second cover materials may be the same material, e.g. cellulose polymer or polypropylene (PP) or a thermoplastic elastomer (TPE).

In a third method for forming an oral care implement in accordance with the present invention, the core 118 is dimensioned such that it will ultimately form part of the neck 140, and optionally also part of the head 120, of the implement 1. Accordingly, the implement 1 of the third embodiment shown in FIG. 4 may be obtained by the third method. In this discussion of the third method, it is assumed that the handle 112 of the implement 1 will have only one second portion 116, as per FIG. 4. The third method is adaptable to create an implement 1 having more than one second portion 116 by using a suitable corresponding number of spacers in the second cavity.

In the third method, the core 118 may be provided in a manner substantially as in any of the embodiments described above, except that the core 118 has a greater longitudinal length. For example, the core may be formed in a first cavity of a mold by injection molding, substantially as described above.

Once provided, the hard core 118 is placed in a second cavity of either the first mold or another mold, substantially as described above for the first or second method, except that the core is spaced from walls of the second cavity in both the first volume and the second volume of the second cavity. The first volume corresponds to the shape of the head 120 and neck 140 of the implement 1 to be formed, the second volume corresponds to the shape of the first portion 114 of the cover 112 of the handle 110 of the implement 1 to be formed, and the first and second volumes are parts of the same, second cavity and thus are in fluid communication with each other. The second cavity has a volume greater than that of the first cavity, to allow the first cover material that will form the first portion 114 of the cover 112 to flow around the core 118 and contact a first part of the surface 119 of the core 118. The core 118 is again spaced from walls of the second cavity by a spacer, such as a shut-off, which contacts a second part of the surface 119 of the core 118. However, due to the increased longitudinal length of the core 118, the core is locally spaced from the walls of the second cavity in both the first and second volumes of the second cavity. Accordingly, the second part of the surface 119 is concealed from the second cavity whereas the first part of the surface 119 of the core 118 is exposed to the second cavity.

Thereafter, the first cover material is introduced to the second cavity in a flowable state substantially as described above for the first or second method. Sufficient first cover material is provided to fully form the first portion 114 of the cover 112. The first cover material covers the first part of the surface 119 of the core 118 while the second part of the surface 119 is concealed. The first cover material is thereafter allowed to harden. Accordingly, the first portion 114 of the cover 112 is overmolded onto the core 118.

Next, mold halves that form the second cavity are separated from each another and the combination of the head 120, neck 140, first portion 114 and core 118 is ejected or otherwise removed from the second cavity. The combination is then placed in a third cavity of either the same mold or of another mold for the creation of the single second portion 116 using second cover material, as discussed above for the second method, such that the cover 112 envelops the core 118.

In respective variations to the above-described first, second and third methods, one or more of the one or more spacers (which may be positioning pins) used in the second cavity are withdrawn from the surface 119 of the core 118 during or after the introduction of the first cover material into the second cavity (but, in any event, while at least a portion of the first cover material is flowable), such that the first cover material fills voids left behind by the removal of the spacer(s) without disturbing the position of the core 118 relative to the walls of the second cavity. Accordingly, the first cover material covers the first part of the surface 119 of the core 118 while the second parts of the surface 119 are concealed, then the first cover material covers one or more of the second parts of the surface 119 after the spacer(s) are withdrawn or removed. The first cover material is thereafter allowed to harden, and the combination is ejected from the second cavity and placed in the third cavity, as discussed above for either of the first and second methods.

A fourth method for forming an oral care implement in accordance with the present invention will now be described. The implement 1 of the fourth embodiment shown in FIG. 5 may be obtained by this fourth method.

In the fourth method, the core 118 of the implement is provided. The core 118 may be formed, either by the relevant part of the first, second or third methods described above, or by any other method.

The hard core 118 is then placed in a second cavity, of either the first mold or of a second mold, which second cavity has a first volume corresponding to the shape of the head 120 and neck 140 of the implement 1 to be formed, and a second volume corresponding to the shape of the final handle 110 to be formed. The first and second volumes are parts of the same, second cavity and thus are in fluid communication with each other. The first volume again has a shape suitable to cause tuft holes to be formed in the head 120. The second volume has a volume configured to allow cover material that will form the cover 112 to flow around the core 118 and contact a first part of the surface 119 of the core 118. The core 118 is spaced from walls of the second cavity by one or more spacers, such as positioning pins, which contact respective second part(s) of the surface 119 of the core 118. Accordingly, the second part(s) of the surface 119 are concealed from the second cavity whereas the first part of the surface 119 of the core 118 is exposed to the second cavity.

Thereafter, the cover material, which in this example is virgin food-grade CAP and/or polypropylene, is introduced to the second cavity in a flowable state. The cover material covers the first part of the surface 119 of the core 118 while the second part(s) of the surface 119 are concealed by the spacer(s).

The one or more spacers is/are then withdrawn from the surface 119 of the core 118 during or after the introduction of the cover material into the second cavity (but, in any event, while at least a portion of the cover material is flowable), such that the cover material fills voids left behind by the removal of the spacer(s) without disturbing the position of the core 118 relative to the walls of the cavity. Accordingly, the cover material covers the first part of the surface 119 of the core 118 while the second part(s) of the surface 119 are concealed, and then covers the second part(s) of the surface 119 after the spacer(s) are withdrawn or removed. Ultimately, the cover material covers all of the surface 199, envelops the core 118 and also forms the outer surface of the implement 1. The cover material is thereafter allowed to harden. Accordingly, the whole cover 112 is overmolded onto the core 118 so as to envelop the core 118.

Next, mold halves forming the second cavity are separated from each another and the body 100 comprising the head 120, neck 140 and handle 110 is ejected or otherwise removed from the second cavity of the second mold.

Finally, the body 100 is subjected to a process for disposing tooth cleaning elements 130 in the tuft holes formed in the head 120, to obtain a finished implement 1.

A fifth method for forming an oral care implement in accordance with the present invention will now be described. The implement 1 of the fourth embodiment shown in FIG. 5 may be obtained by this fifth method.

In the fifth method, rather than covering a hard core 118 with cover material, the method comprises enveloping core material (comprising recycled material) with cover material, while the core material is soft and/or in a flowable state. The fifth method comprises a dual injection process into a single cavity mold, in which core material comprising recycled material is injected into the cover material already disposed in a mold cavity, while at least a portion of the cover material is soft and/or in a flowable state.

First, a cavity of a mold is provided, which cavity has a first volume corresponding to the shape of the head 120 and neck 140 of the implement 1 to be formed, and a second volume corresponding to the shape of the final handle 110 to be formed. Again, the first and second volumes are parts of the same cavity and thus are in fluid communication with each other.

A mass of cover material, which in this example is virgin food-grade CAP and/or polypropylene, is introduced to the cavity in a flowable state before the core material (comprising recycled material) that will form the core 118 is introduced to the cavity. More particularly, a short shot of the cover material is injected into the cavity. In other words, the volume of the mass of cover material introduced to the cavity is smaller than the volume of the cavity itself, and smaller than the volume of the body 100 of the implement 1 to be manufactured. Outer parts of the mass of cover material, which contact the walls of the cavity, begin to harden, since the walls of the cavity are cooled.

While an inner portion of the mass of cover material is still soft, a mass of core material, which comprises or consists of recycled polypropylene and/or other recycled material, and which will form the core 118 of the implement 1, is injected into the cavity and specifically into the inner portion of the mass of cover material. The cover and core materials are then allowed to harden. (If any of the core material remains exposed to the walls of the cavity, a small quantity of cover material subsequently may be injected into the cavity to fully isolate the core material from the walls of the cavity). As a result, the cover formed from the cover material envelops the core formed from the core material.

Finally, the body 100 is subjected to a process for disposing tooth cleaning elements 130 in the tuft holes formed in the head 120, to obtain a finished implement 1.

In respective variations to the above-described methods, in cases where the core 118 has one or more holes therethrough, the cover material (such as the second cover material) may be permitted to pass through the hole(s) during injection thereof, such as to more easily form plural second sections 116 of the cover 112 that are spaced apart from one another on a surface of the implement 1 being formed.

In respective variations to the above-described methods, the structures that are recycled to create the pellets or flakes may be made of a plastic material other than polypropylene, or may comprise more than one type of plastic material. In still further variations, the structures may comprise or consist of non-plastic material.

While in each of the above described methods the recycled material, which is comprised in or as core material, comprises recycled polypropylene, in variations to these methods the recycled material may additionally or alternatively comprise one or more post-consumer recycled plastic materials selected from the group comprising: polypropylene (PP), polystyrene (PS), low density or high density polyethylene (LDPE, HDPE), polyethylene terephthalate (PET), acrylonitrile butadiene styrene (ABS), cellulose propionate (CP), polyacrylate, polycarbonate, and styrene acrylonitrile (SAN). In further variations, in addition to one or more recycled plastic materials, in other embodiments, the core material may also comprise one or more further non-recycled (i.e. virgin) plastic materials, such as one or more materials selected from the above list. Alternatively or additionally, in addition to one or more recycled plastic materials, the core material may also comprise one or more further recycled or non-recycled non-plastic materials, such as a metal or an alloy, a ceramic, glass, a composite, or organic material such as wood dust, wood saw dust or wood chippings.

In still further variations to the above-described methods, foaming agent and/or colourant may be omitted from the core material.

While in each of the above described methods the cover material comprises polypropylene and/or cellulose acetate propionate, in variations to these methods the cover material may additionally or alternatively comprise one or more other materials, such as material selected from the group comprising: polypropylene (PP), polystyrene (PS), low density or high density polyethylene (LDPE, HDPE), polyethylene terephthalate (PET), acrylonitrile butadiene styrene (ABS), cellulose propionate (CP), polyacrylate, polycarbonate, and styrene acrylonitrile (SAN). In any event, it is preferable that the cover material is free of recycled material, or at least is free of post-consumer recycled material. In some embodiments, the cover material (such as one or both of the first and second cover materials discussed above) comprises pre-consumer recycled material.

In respective variations to each of the above described methods in which the cover material forms a transparent cover or portion thereof, the cover material may instead form a translucent or an opaque cover or portion thereof.

In still further variations to the above-described methods, the methods may comprise further step(s) in which additional components and/or materials are disposed on the outside of the cover out of contact with the core.

In still further variations to the above-described methods, the disposition of cleaning element(s) 130 in the head 120 may not involve stapling. Other known methods for disposing tooth cleaning element(s) 130 in tuft holes after the completion of the injection molding process(es) may be used. Alternatively, the cleaning element(s) 130, such as tooth cleaning elements and/or tissue cleaning elements, may be formed of the cover material during the injection of the cover material into a mold cavity, in which case the cavity would not have a shape suitable to cause tuft holes to be formed in a head 120, but rather would have a shape suitable to cause the cleaning element(s) 130 to be formed integrally with the head 120 from the cover material. The disposition of cleaning element(s) 130 in the head 120 may be achieved during or after the formation of the head 120 by anchor free tufting or by any other method.

In still further variations to the above-described methods, the head 120 and/or the neck 140 of the implement 1 may not be created from the cover material. That is, the head 120 and/or the neck 140 may not be integrally formed with the cover 112 of the implement 1 by the same formation process. In such cases, the head 120 and/or the neck 140 may be connected to the handle 110 in a subsequent process, such as by overmolding the material of the head 120 and/or the neck 140 onto the handle 110. Alternatively, the head 120, and optionally also the neck 140, may be formed as a component separate from the handle 110 but connectable to the handle 110. In such cases, the above-described respective cavities used to form the cover 112 would be suitably shaped to form the handle 110 without, or in isolation from, the head 120, and optionally also without, or in isolation from, the neck 140. That is, the cavities could exclude a volume corresponding to the shape of the head 120, and optionally also corresponding to the neck 140, of the implement 1 to be formed.

What is claimed is:

1. An oral care implement, comprising:

a handle having a core and a cover surrounding an entirety of the core so that no portion of the core is exposed; and a head comprising at least one cleaning element, the head being connected to the handle; and wherein the head and the cover of the handle are integrally formed as a unitary part;

wherein a first portion of the cover is made from a first material and a second portion of the cover is made from a second material;

wherein the first material is a hard material and the second material is an elastic material; and wherein the cover comprises a plurality of the second portions spaced apart from one another along the handle.

2. The oral care implement of claim 1, wherein the core comprises a foamed material.

3. The oral care implement of claim 1, wherein the cover is at least partially transparent.

4. The oral care implement of claim 1, wherein the cover is overmolded onto the core.

5. The oral care implement of claim 1, wherein the handle comprises one or more sections that are overmolded onto the cover and out of contact with the core.

6. The oral care implement of claim 1, wherein the head comprises at least one tooth cleaning element and the oral care implement comprises a toothbrush.

* * * * *